US006609363B1

(12) United States Patent
Dressler et al.

(10) Patent No.: US 6,609,363 B1
(45) Date of Patent: Aug. 26, 2003

(54) IODINE ELECTRIC PROPULSION THRUSTERS

(75) Inventors: Rainer A. Dressler, Arlington, MA (US); Dale J. Levandier, Westford, MA (US); Yu-Hui Chiu, Waltham, MA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/747,518

(22) Filed: Dec. 26, 2000

Related U.S. Application Data

(63) Continuation-in-part of application No. 09/377,506, filed on Aug. 19, 1999, now abandoned.

(51) Int. Cl.[7] ..... F03H 1/00
(52) U.S. Cl. ..... 60/202; 60/203.1
(58) Field of Search ..... 60/202, 203.1

(56) References Cited

U.S. PATENT DOCUMENTS 3,634,150 A * 1/1972 Horn ..... 148/175
4,434,492 A * 2/1984 Bernard et al. ..... 372/59
6,286,304 B1 * 9/2001 Back et al. ..... 60/202

* cited by examiner

*Primary Examiner*—Louis J. Casaregola
(74) *Attorney, Agent, or Firm*—Thomas C. Stover

(57) ABSTRACT

The invention provides an improved spacecraft thruster, either Hall effect or ion effect, using gaseous propellant converted from solid iodine. A heated tank contains iodine crystals, which tank connects to a thrust chamber by a feed tube. A filter is mounted at the input end of the feed tube, proximate the tank, which filter is warmed by a heat control. A mass flow controller is mounted in the feed tube between the tank and the chamber and is heated by a temperature controller, such controller having a shut-off valve and means to control the flow rate of gaseous propellant to the thruster chamber.

3 Claims, 2 Drawing Sheets

IODINE ELECTRIC PROPULSION THRUSTERS

CROSS-REFERENCE TO RELATED PATENT APPLICATIONS

This application is a CIP of application Ser. No. 09/377,506 filed on Aug. 19, 1999 (abandoned) having the same title and inventorship.

STATEMENT REGARDING FEDERALLY SPONSORED RESEARCH OR DEVELOPMENT

The invention described herein may be manufactured and used by or for the Government for governmental purposes without the payment of any royalty thereon.

FIELD OF THE INVENTION

The present invention relates to thrusters, and, in particular, relates to thrusters for controlling spacecraft.

BACKGROUND OF THE INVENTION

A key technology to lowering the cost of launching and maintaining future satellites are new, efficient propulsion systems. Electric propulsion thrusters are of great interest because of their substantially higher exhaust velocity compared with traditional chemical propulsion thrusters which allows for significant mass reduction of the spacecraft propulsion system, thereby increasing the payload to spacecraft mass ratio. Highly promising thruster designs already finding use are ion and Hall-effect thrusters. In these engines, a gas is efficiently ionized and electrostatically accelerated to provide thrust. The current gas of choice has been xenon, given its high mass, relatively low ionization potential, low chemical reactivity and excellent discharge properties. Xenon, however, is very expensive, and it is anticipated that with the growing use of xenon in space, the price will steadily increase during the coming years. There is, therefore, considerable interest in finding cheaper alternative propellants that still meet the required performance criteria. Other noble gases, such as krypton and argon, have been tried, but they don't have the desired performance that xenon offers given their lower mass and higher ionization potentials. While earlier ion and Hall-effect thruster models included metallic propellants, such as cesium and mercury which met the high atomic mass, low ionization potential requirement, these fuels have many disqualifying drawbacks such as the necessity to heat the metal to generate sufficient vapor pressure, the possibility of depositing metal coatings on insulators and causing short circuits, and environmental concerns at ground level.

Thus, there exists a need for a cost effective thruster that overcomes the above prior art shortcomings.

SUMMARY OF THE INVENTION

Broadly the present invention provides an improved spacecraft thruster, either Hall effect or ion, using gaseous propellant evaporated from solid iodine. The means for converting the solid iodine is a) a tank for iodine crystals, b) means to control the temperature in the tank, c) a thrust chamber, d) a feed tube connecting the tank and the chamber, e) a filter mounted at the input end of the feed tube proximate the tank, f) means to control the temperature in the filter, g) a mass flow controller having a valve for flow control and shut-off mounted in the feed tube between the tank and the chamber and h) means to control the temperature in the mass flow controller.

While 1 kg of iodine (99.999%) costs approximately $400, the current cost of one kg of xenon (99.995%) is ~$4,000. However, iodine exhibits many desired propellant features: The iodine atomic weight is 126.9 amu versus that of xenon, 131.3 amu. The ionization potential of atomic and molecular iodine are 10.45 eV and 9.4 eV, respectively, versus 12.13 eV of xenon. Since iodine is a solid with sufficient vapor pressure (0.3 Torr at 25° C. and 1 Torr at 40° C.), considerable mass and volume savings are possible with respect to propellant storage. Potential drawbacks of iodine are the molecular form (versus the atomic form of xenon), its corrosiveness, and its ability to attach electrons.

Therefore, one object of the present invention is to provide a spacecraft thruster fuel which is substantially less expensive than present fuels.

Another object of the present invention is to provide a fuel which does not require a pressurized tank and therefore to reduce the mass of the fuel handling system.

Another object of the present invention is to provide a fuel which either exceeds or meets the efficiency of present fuels such as xenon.

These and other objects and advantages of the present invention will be readily apparent to one skilled in the pertinent art from the following detailed description of a preferred embodiment of the invention and the related drawings.

DETAILED DESCRIPTION OF THE INVENTION

Figure 1:
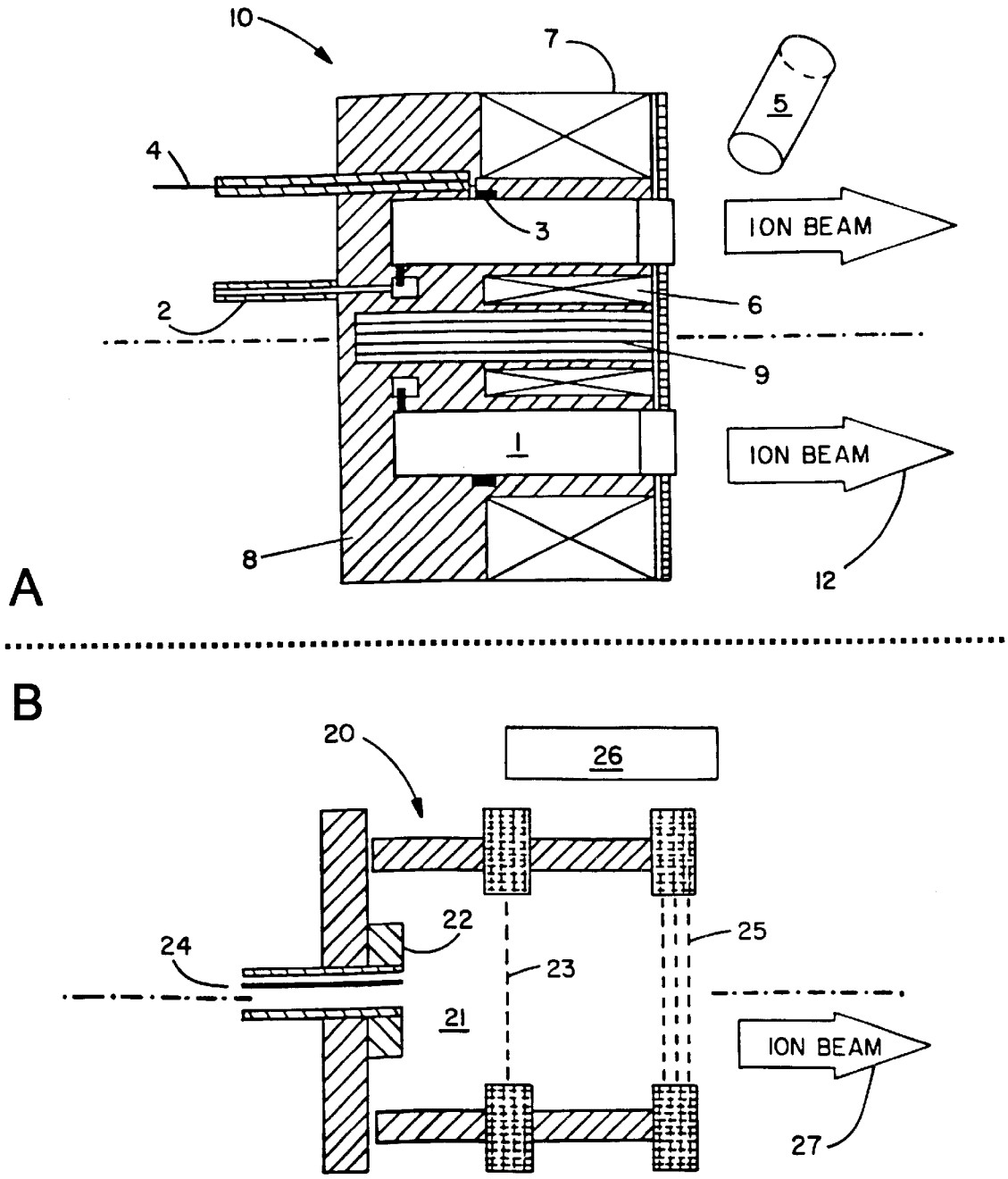
FIG. 1A illustrates a Hall effect thruster.
FIG. 1B illustrates an ion thruster.

A conventional Hall-effect thruster 10 and a conventional ion thruster 20 are shown in FIGS. 1A and 1B, respectively. In a Hall-effect thruster 10, the thruster propellant enters an annular channel 1 through an inlet system 2. The propellant is efficiently ionized in the channel by striking a dc discharge between an anode 3 with electrical lead 4 and a hollow cathode 5. A high electron current density is achieved through the use of an inner, axial 6, and outer magnetic coils 7 that generate a radial magnetic field. The structure is defined by insulating wall material 8, and the magnetic circuit is controlled with soft iron core material 9. The voltage between the hollow cathode 5 and the anode 3 determines the ion kinetic energy in the emerging ion beam 12. Typically, a voltage difference of 300 V is applied. The hollow cathode 5 also serves to emit electrons and neutralize the ion beam (i.e., close the electrical circuit), thereby maintaining the potential of the spacecraft. An example of a Hall-effect thruster 10 has been described in an Article by Guerrini et al entitled "An Intense Hall-type Ion Source for Satellite Propulsion", Rev. Sci. Instr. 69, 804–806 (1998).

In an ion thruster 20, a dc (direct current) or rf (radiofrequency) discharge is struck in an ionization chamber 21 defined by a cathode 22, a grid anode 23 and a propellant inlet 24. The positive ions emerging from the plasma in 21 are accelerated between the anode 23 and a set of one or more acceleration grids 25 by applying a negative acceleration voltage between 23 and 25. The potential difference determines the ion beam energy. As in the Hall-effect thruster 10, the ion beam 27 is neutralized using an electron emitting device 26 such as a hollow cathode. An example of an ion thruster 20 is described in an Article by Cappaci et al entitled "New Ion Source Design for Ion Propulsion Application", Rev. Sci. Instrum. 69 (2), 788–790 (1998).

Figure 2:
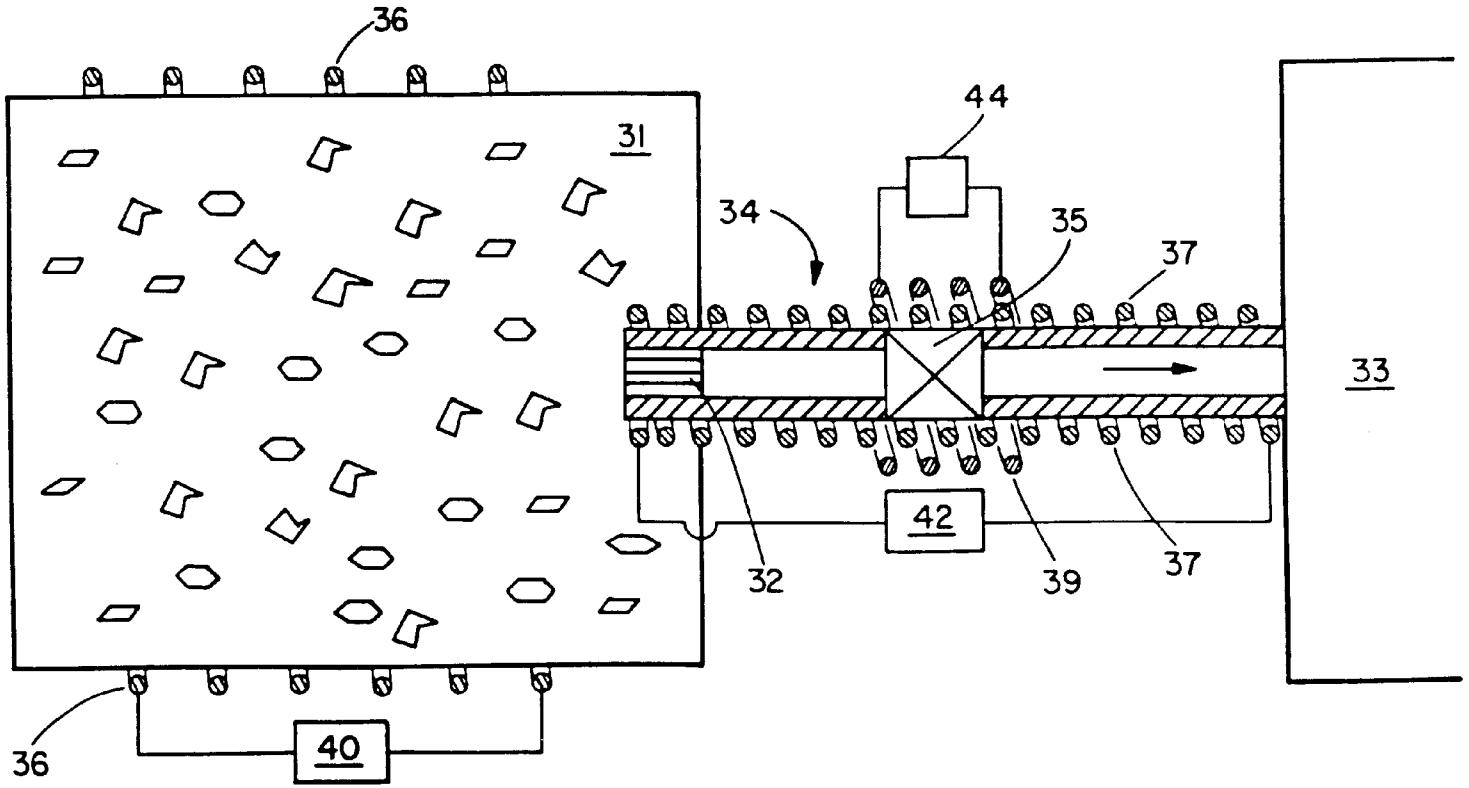
FIG. 2 illustrates a system for using solid iodine in the Hall effect and ion thrusters.

The use of a solid $I_2$ (molecular iodine) propellant calls for minor changes to the propellant handling system. A potential design of an $I_2$ propellant handling system is schematically shown in FIG. 2. Iodine crystals are stored in a stainless steel vacuum tight tank 31 heated by electrical heating coil 36 with temperature control 40. This tank 31 can have a significantly lower mass than that of a high pressure gas cylinder as required for a gaseous Xe propellant given the low vapor pressure of iodine. During orbit, the lack of a gravitational force will cause the crystals to migrate (float) within the tank volume. A frit 32, either manufactured from glass or a microporous ceramic material, is heated by electrical heating coil 37 and temperature control 42 to temperatures higher than that of the tank and prevents passage of crystals with sizes exceeding holes therein into the discharge chamber 33, which can be, e.g., like the chamber 21 of the thruster 20, shown in FIG. 1B or like the chamber 1 of the thruster 10, shown in FIG. 1A. The iodine vapor that passes the frit enters a feed tube 34 that is also heated by coil 37 to temperatures higher than the tank temperature to prevent iodine condensation. The feed-tube preferably consists of a ceramic material or an inconel stainless steel that is resistant to corrosion. Some stainless steels could be subject to corrosive action by iodine at elevated temperatures. A temperature-controlled (by coils 37 and 39 with temperature controls 42 and 44) mass-flow controller combined with a shutoff valve 35 maintains a constant propellant flow rate. Given the critical importance of this device, it is kept at the highest temperature of the propellant handling system.

Typical thruster firing flow rates for smaller Xe Hall thrusters are less than 10 mg $s^{-1}$. In order to sustain such a flow rate over longer periods of time, cooling of the tank 31 and iodine propellant due to expenditure of the vaporization free energy must be prevented. Cooling would lower the vapor pressure and eventually shut down the propellant flow. The free energy of sublimation of iodine is 19.3 kJ/mol. 10 mg of $I_2$ correspond to $3.94 \cdot 10^{-5}$ mol. Consequently, the tank needs to be heated only with 0.76 W of electrical power by coil 36, to prevent the temperature of the tank from dropping during a thruster firing. This is negligible with respect to the power requirements of the thruster discharge. All of the technology involved in an arrangement shown in FIG. 2 is commercially available.

The main advantages of the iodine propellant over conventional xenon propellant are the substantially lower cost, and the smaller and lighter propellant storage facility. 1 kg of solid iodine (99.999%) has a current market value of $400 versus an approximate cost of 1 kg of 99.995% xenon of $4,000. Meanwhile, the abundance of iodine in the Earth's crust is about 25,000 higher than xenon, indicating that the supply of iodine will not be affected by increased use in spacecraft thrusters, signifying higher price stability.

Further cost-savings could be achieved by using lower purity propellant. 99.5% iodine only costs $100. On-site purification, if necessary, could be obtained by subliming the iodine directly into the propellant tank. The tank is not required to withstand high pressures and can therefore consist of thin stainless steel walls, thereby increasing the payload-to-weight ratio of the spacecraft. Both advantages result in dramatically lowering the launch and orbit cost of a spacecraft.

There are still questions relating to the performance of an iodine propellant. Important specifications of a thruster are efficiency, input power, thrust, and specific impulse. Xenon-based Hall engines have exhibited efficiencies exceeding 50% and specific impulses higher than 1500 s. The ionization potential and mass of the propellant have a strong effect on the thrust and required input power. The lower the ionization potential the less energy is required to produce an ion-electron pair. The ionization potentials of both atomic (10.45 eV) and molecular (9.4 eV) iodine compare favorably to xenon (12.13 eV). The atomic mass of iodine is only slightly lower than that of Xe (127 versus 131 amu).

Efficiency is largely determined by the discharge properties of the propellant. In Hall-effect and ion thrusters, high ionization efficiencies near 80% are sought at a minimal power input. In this aspect, there are some important differences between the properties of iodine and xenon. Whereas xenon is an atom, iodine is a molecule that in addition to electronic internal energy states also has rotational and vibrational degrees of freedom. Since internal excitation of exhaust molecules signifies loss of translational (thrust) energy, it is possible that previous searches for alternative propellants for Hall-effect and ion thrusters only considered atomic species, such as the noble gases and metals.

However, there are sufficient reasons to believe that an iodine thruster could be an efficient engine despite the molecular form of the propellant. Iodine has a low bond energy of only 1.6 eV. Consistent with this characteristic, it has been found that more than 90% of molecular iodine is dissociated into iodine atoms in low pressure radiofrequency discharges of xenon-iodine mixtures (0.5 Torr xenon, 0.3 Torr iodine)[3].

Another important difference between xenon and iodine is the ability of iodine to attach electrons. Whereas xenon negative ions are unstable, iodine atoms and molecules have high electron affinities. Iodine negative ions can be formed in dissocative attachment reactions:

$$I_2 + e^- \rightarrow I^- + I$$

This process is most efficient at near-thermal electron energies and could represent an energy and electron loss mechanism. Electron attachment should be a minor process at the typical operation conditions of Hall-effect and ion thrusters, where high E/N values signifying high average electron energies govern the discharge.

Finally, a disadvantage of iodine is its moderate corrosiveness. This should not be a problem considering the use of substantially more corrosive fuels such as hydrazine and ammonia in space.

Clearly many modifications and variations of the present invention are possible in light of the above teachings and it is therefore understood, that within the inventive scope of the inventive concept, that the invention may be practiced otherwise than specifically claimed.

What is claimed is:

1. An improved thruster for spacecraft comprising, a) a tank for iodine crystals, b) means to control the temperature in said tank, c) a thrust chamber, d) a feed tube connecting said tank and said chamber, e) a filter mounted at the input end of said feed tube proximate said tank, f) means to control the temperature in said filter, g) a mass flow controller having a valve for flow control and shut-off mounted in said feed tube between said tank and said chamber and h) means to control the temperature in said mass flow controller.

2. The thruster of claim 1 wherein said thrust chamber includes a Hall-effect thruster.

3. The thruster of claim 1 wherein said thrust chamber includes an ion thruster.

* * * * *